US009743747B2

(12) United States Patent
Perez

(10) Patent No.: US 9,743,747 B2
(45) Date of Patent: Aug. 29, 2017

(54) MULTI-SURFACE CLEANING IMPLEMENT

(71) Applicant: Amparo Del Carmen Perez, Hialeah, FL (US)

(72) Inventor: Amparo Del Carmen Perez, Hialeah, FL (US)

( * ) Notice: Subject to any disclaimer, the term of this patent is extended or adjusted under 35 U.S.C. 154(b) by 344 days.

(21) Appl. No.: 13/938,803

(22) Filed: Jul. 10, 2013

(65) Prior Publication Data

US 2013/0291327 A1 Nov. 7, 2013

Related U.S. Application Data

(63) Continuation-in-part of application No. 12/826,547, filed on Jun. 29, 2010, now abandoned.

(60) Provisional application No. 61/270,209, filed on Jul. 6, 2009.

(51) Int. Cl.

| | |
|---|---|
| ***A46B 9/00*** | (2006.01) |
| ***A46B 9/02*** | (2006.01) |
| ***A46B 5/00*** | (2006.01) |
| ***A47K 11/10*** | (2006.01) |
| *A46B 5/02* | (2006.01) |

(52) U.S. Cl.

CPC ..... *A46B 9/02* (2013.01); *A46B 5/0095* (2013.01); *A46B 9/00* (2013.01); *A46B 9/026* (2013.01); *A47K 11/10* (2013.01); *A46B 5/02* (2013.01); *A46B 2200/30* (2013.01); *A46B 2200/302* (2013.01); *A46B 2200/3026* (2013.01); *A46B 2200/405* (2013.01)

(58) Field of Classification Search

CPC ... A46B 9/02; A46B 2200/20; A46B 2200/30; A46B 2200/405; A46B 2200/302; A46B 2200/3026; A46B 9/00

USPC .... D4/130, 135, 99, 119, 32; 15/159.1, 160, 15/175, 106

See application file for complete search history.

(56) References Cited

U.S. PATENT DOCUMENTS

| | | | | | |
|---|---|---|---|---|---|
| 313,776 | A | * | 3/1885 | Sebring | A46B 9/02 15/160 |
| D159,979 | S | * | 9/1950 | Gregory | D4/115 |
| 3,046,587 | A | * | 7/1962 | Hamburger | A46B 9/02 15/111 |
| 4,360,940 | A | * | 11/1982 | Smith | A46B 9/02 15/160 |

(Continued)

*Primary Examiner* — Michael Jennings
(74) *Attorney, Agent, or Firm* — The Concept Law Group, P.A.; Scott D. Smiley

(57) ABSTRACT

A surface cleaning implement for use with an elongated handle is provided. The implement includes a largely rectangular and asymmetric body region with rounded outer edges, largely planar upper and lower surfaces, and upstanding contact material coextensively disposed thereon. The body region is a largely flattened structure having a first and second leading edge corner, the corners comprising where the leading edge of the body region transitions to the side edges. The first corner comprises a large, sweeping radius for cleaning curving and open surfaces. The second corner comprises a sharp corner having a small radius, chamfered, protuberant, or largely square corner wherein overly elongated and stiffened contact material extends therefrom for contacting surfaces within corners or within confined areas. The head region includes a back end having a handle receiving sheath and suitable support therefor, wherein an elongated handle is attached thereto for use away from the user's person.

14 Claims, 2 Drawing Sheets

(56) References Cited

Figure 1:
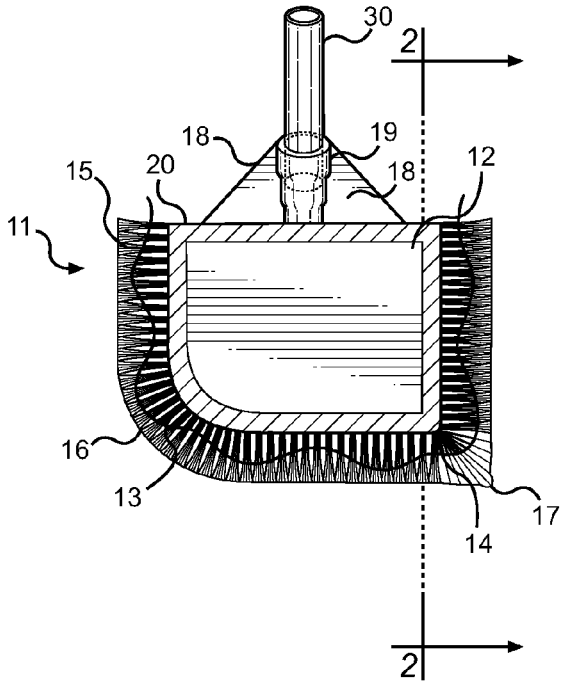

U.S. PATENT DOCUMENTS 5,033,155 A 7/1991 Klotz
D337,660 S * 7/1993 Ricciarelli ..... D4/138
5,375,287 A * 12/1994 Dillahunt ..... A47L 13/10 15/106
6,088,868 A * 7/2000 Cerveny ..... A46B 5/0033 15/144.1
D428,706 S * 8/2000 Thunderchild ..... D4/132
D439,054 S * 3/2001 Schloesser ..... D4/130
D457,327 S * 5/2002 Liu ..... D4/115
D495,500 S * 9/2004 Berti ..... D4/138
D501,325 S * 2/2005 Berti ..... D4/138
6,925,686 B2 * 8/2005 Heathcock ..... B25G 1/04 15/144.4
D509,660 S * 9/2005 Listenberger ..... D4/138
D584,863 S * 1/2009 Garry ..... D30/158
D598,202 S * 8/2009 McNeil ..... D4/132
7,841,038 B2 * 11/2010 Vosbikian ..... A46B 5/0075 15/106
D630,857 S * 1/2011 Cox ..... D4/138
8,276,236 B2 * 10/2012 Goodman ..... A47L 11/38 15/144.1
8,881,684 B1 * 11/2014 Yazdanpanah ..... A46B 7/04 119/600
2003/0156884 A1 * 8/2003 Teh ..... A46B 9/02 401/39
2006/0117510 A1 * 6/2006 Sellers ..... A46B 9/02 15/160
2007/0169293 A1 * 7/2007 Wang ..... A46B 17/06 15/159.1
2009/0064434 A1 * 3/2009 Mallaridas ..... B05C 17/0232 15/144.4
2010/0017987 A1 * 1/2010 Lyons ..... A46B 5/00 15/160
2011/0035894 A1 * 2/2011 Goldhammer ..... A46B 5/0008 15/160

* cited by examiner

MULTI-SURFACE CLEANING IMPLEMENT

CROSS REFERENCE TO RELATED APPLICATION

This application is a Continuation in Part of U.S. patent application Ser. No. 12/826,547 filed on Jun. 29, 2010, entitled "Ergonomic Shaped Household Cleaning Brush," now pending, which claims the benefit of U.S. Provisional Application No. 61/270,209, entitled "Adjustable Shaped Shower and Tub Scrubbing Brush" and filed on Jul. 7, 2009. Each patent application identified above is incorporated here by reference in its entirety to provide continuity of disclosure.

BACKGROUND OF THE INVENTION

Field of the Invention

The present invention relates generally to a manually-operated household cleaning tool, and more particularly to household cleaning tool having optimum geometry for cleaning different surfaces and surface intersections in a typical household or commercial space.

Cleaning the different surfaces of a residence or commercial space requires the correct cleaning implements in order to properly contact all necessary areas during a cleaning operation. In many indoor spaces, the geometry of the room and intersections between different appliances and fixtures create a multi-faceted and multi-surface environment that requires contact cleaning. In some areas, a square broom or bristled implement may be sufficient. In other areas, a rounded implement may be requires to sweep across curving or complex surfaces.

The present invention provides a cleaning implement intended for manual use, wherein the implement is particularly suited to the application of cleaning basins and tubs, especially those embodied by showers, bathtubs, Jacuzzis, and other fixtures generally found in bathrooms. The geometry of the implement is optimized for maintaining uniform contact with a variety of potential fixture shapes to ensure the efficient scrubbing necessary for effective cleaning. The orientation and dimensions of the brush handle are ideal for use by the operator in a wide variety of potentially restricted spaces.

In addition to these bathroom surfaces, the present invention embodies significant utility for the purposes of removing dirt from baseboards and walls because of the wide surface contact area the of the device, wherein removal of accumulated dirt and cobwebs in corners is facilitated by way of the unique bristle geometry. Specifically, the present invention provides a variable surface cleaning implement having a first rounded corner and second sharp corner having elongated and protruding bristles extending therefrom for cleaning open spaces or in narrow corner regions.

Description of the Prior Art

Devices have been disclosed in the prior art that relate to cleaning implements and brush heads. These include devices that have been patented and published in patent application publications, and generally relate to cleaning implements of diverging qualities and elements with respect to the present invention. The following prior art is herein described for the purposes of highlighting and differentiating the unique aspects of the present invention, and further highlighting the drawbacks existing in the prior art.

Specifically, U.S. Pat. No. 5,033,155 to Klotz discloses a long-handled brush suitable for cleaning hollow bodies. The cleaning head includes an elastic core and an outer covering of felt or felt-like material. The cleaning head is cylindrical in shape while the handle is telescopic to allow for reaching away from one's person. The Klotz device, while describing a cleaning implement having a handle and a head, fails to disclose the novel aspects of the present cleaning implement. Notably, the present invention provides a cleaning implement head having an asymmetrical design to allow for cleaning sweeping surfaces or tight corners that are otherwise hard to clean with the same tool. Additionally, the head and the handle of the present invention preferably have an angular disposition with respect to one another to keep a safe distance between the focused cleaning area and the hands of the operator when cleaning vertical or horizontal surfaces.

Several devices are disclosed in the art that relate to cleaning brushes having a shaped head and upstanding bristles. While these devices are useful for scrubbing and abrasive cleaning, these articles fail to anticipate the exact structure and multi-surface use of that provided by the cleaning implement of the present invention. Most of the devices in the art include bristled cleaning implements with a given shape or a given application, wherein the elements of these articles significantly diverge from that of the present invention.

One such device is U.S. Pat. No. D439,054 to Schloesser, which discloses an ornamental design for a multi-purpose brush. The shape of Schloesser device, while novel in itself, does not contemplate an asymmetrical head design with angular leading corners of different radius. U.S. Pat. No. 6,845,539 to Tubman is another such device that discloses a brush head having a cylindrical core member, extended bristles in a tapered arrangement therefrom, and a handle member. Similarly, the Tubman device comprises a different bristle body and one that does not contemplate an asymmetric head for facilitating multi-surface and multi-corner cleaning. Finally, U.S. Pat. No. 6,804,852 to Hay discloses a toilet bowl cleaning brush that includes an elongate block and bristles useful for cleaning a toilet bowl overhang. While useful for cleaning an overhead surface adjacent to the handle attachment to the head, the Hay device fails to disclose the novel aspects of the present invention.

While these devices disclose cleaning implements having a head and extended bristles, the present invention discloses a multi-surface cleaning implement having an asymmetric and largely rectangular body region with a first and second leading corner. The leading corners are of differing radiuses to allow for broad surface cleaning and large curving surfaces along one corner, while facilitating cleaning of narrow or sharp corner regions using the opposing leading corner. Bristles are disposed on the device, wherein the bristles are substantially uniform thereon with the exception of the sharp leading corner region, wherein the bristles are extended outward beyond the bristles on the rest of the head and may comprise a higher stiffness for reaching difficult-to-reach surfaces.

It is submitted that the present invention is substantially divergent in design elements from the prior art, and consequently it is clear that there is a need in the art for an improvement to existing cleaning implements. In this regard the instant invention substantially fulfills these needs.

SUMMARY OF THE INVENTION

In view of the foregoing disadvantages inherent in the known types of cleaning implements now present in the prior art, the present invention provides a new and unique cleaning head wherein the same can be utilized for providing convenience for the user when cleaning broad, sweeping surfaces and tight, narrow corners with the same tool.

It is therefore an object of the present invention to provide a new and improved cleaning implement that has all of the advantages of the prior art and none of the disadvantages.

It is another object of the present invention to provide a cleaning implement that includes an asymmetrical shape and a largely flattened body, wherein the device can be placed against a surface and forced against a perpendicular surface thereto for abrasive cleaning or dust removal.

Another object of the present invention is to provide a cleaning implement having a first forward corner adapted for sweeping surfaces, and a second corner for contacting corner surfaces that are otherwise difficult to reach with broad implements.

Yet another object of the present invention is to provide a cleaning implement that includes a body region largely covered in bristles, wherein the bristles can be stiffened for abrasive cleaning or medium to soft bristles for removing loose dirt and dust from surfaces.

A final object of the present invention is to provide a cleaning implement that includes an attachment for a handle of given length (short, medium, or elongated length) and disposed at an angle with respect to the implement head. The angled handled maintains the implement at a convenient distance from the user to separate the user from pathogens, dirt, dust, chemicals, or water, and further prevent hand injuries to the user during vigorous use.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

FIG. 1 shows an overhead cut-away view of the present cleaning implement, wherein the bristles along the upper surface of the device are removed for the purposes of clarity.

Figure 2:
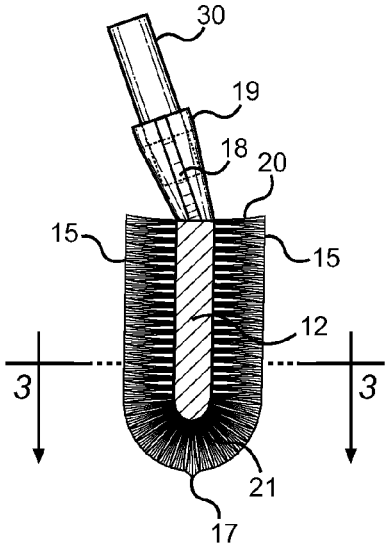

FIG. 2 there is shown a cross section side view of the present cleaning implement.

Figure 3:
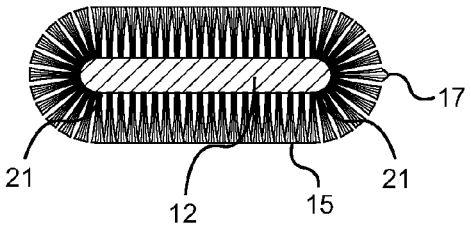

FIG. 3 there is shown a cross section end view of the present cleaning implement.

Figure 4:
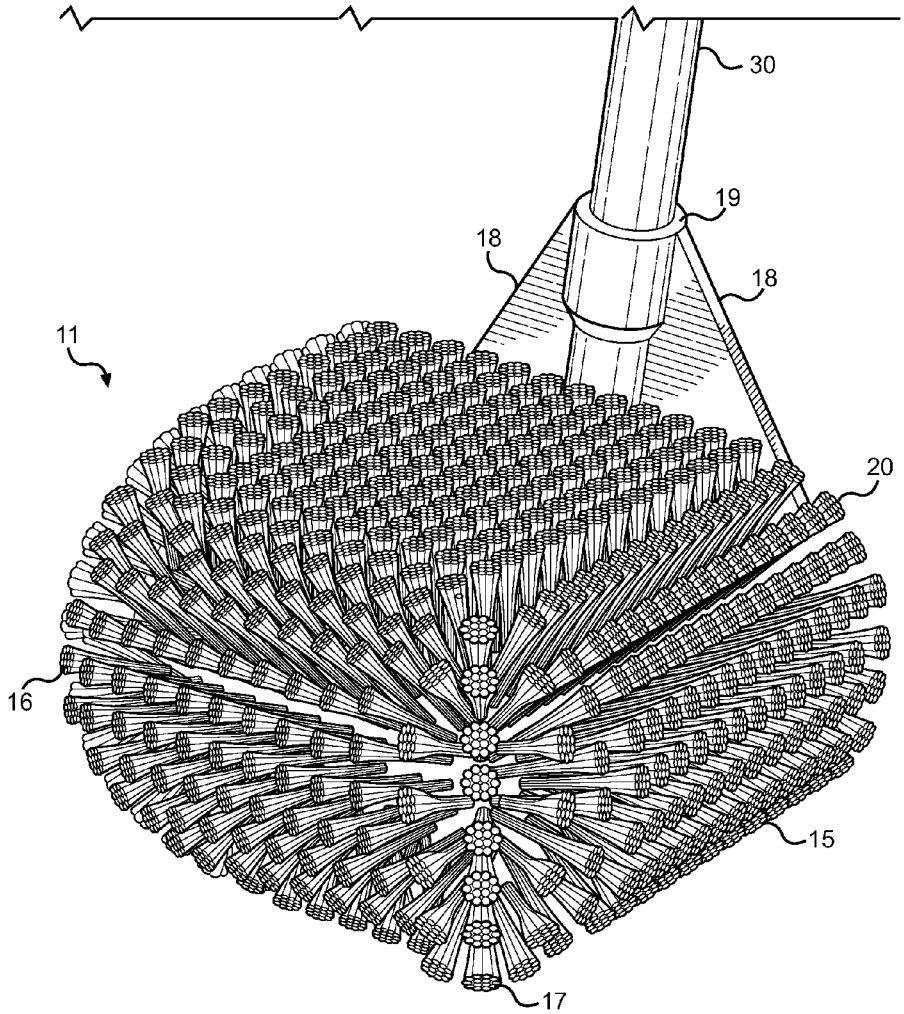

FIG. 4 there is shown a perspective view of the present cleaning implement attached to an elongated handle.

DETAILED DESCRIPTION OF THE INVENTION

Reference is made herein to the attached drawings. Like reference numerals are used throughout the drawings to depict like or similar elements of the cleaning implement. For the purposes of presenting a brief and clear description of the present invention, the preferred embodiment will be discussed as used for cleaning multi-faceted surfaces and interior spaces with multiple, intersecting surfaces requiring abrasive or touch cleaning. The figures are intended for representative purposes only and should not be considered to be limiting in any respect.

Referring now to FIG. 1, there is shown an overhead view of the cleaning implement 11 of the present invention, wherein the upper portion of the implement is shown in a cut-away view to highlight the structure underlying the cleaning bristles 15. The implement 11 comprises a largely rectangular body region 12 having a largely planar upper and lower surface, a rear end wall 20, and a rounded perimeter sidewall between the body region upper and lower surfaces. The surfaces of the body region 12, with the exception of the rear wall 20, include an array of bristles 15 disposed thereon and extending therefrom for cleaning purposes. The bristles 15 are stiffened members, or medium to soft cleaning/wiping elements that are largely coextensive with the surfaces of the implement and provide for abrasive cleaning or light dust removal, depending on the bristle type deployed.

Along the leading edge of the body region is a first 13 and second 14 leading corner that provide for the asymmetrical shape of the implement and thus the multi-surface cleaning ability. The corners transition the leading edge of the body region 12 to the sides of the body region, wherein the first corner 13 comprises a large radius curvature and the second corner 14 comprises a sharp (small radius) corner, chamfered region, or protruding edge. The second corner 14 supports bristles 17 that are particularly elongated or positioned outward from the rest of the body region so as to extend beyond those bristles along the rest of the body region 12. These extended bristles facilitate cleaning of sharp corners and hard-to-reach locations.

Along the rear wall 20 of the implement 11 is a handle receiving sheath 19 that preferably extends upwardly from the plane of the rectangular body region or is aligned therewith. The preferred arrangement provides an angled handle with respect to the body region. The sheath 19 is adapted to accept a cylindrical handle member 30 therethrough, whereby the handle 30 may be attached by way of a suitable fastener or by way of a threaded connection within the interior of the sheath. This connection is not desired to be limited to one of specific design, but rather it is desired to disclose a means of connecting an elongated handle 30 to the implement for use away from the user's body. Along the flanks of the sheath 19 may also be provided structural gussets 18 to support the sheath 19, preventing yielding of the connection between the sheath 19 and body region 12 while in use and being subjected to user load.

Referring now to FIGS. 2 and 3, there are show two cross section views of the cleaning implement of the present invention. In these views, the rounded edges 21 of the body region 12 is readily visualized, along with the direction and density of cleaning bristles 15 disposed therealong. The rounded edges 21 include a dual fillet that combine to create a rounded outer peripheral edge to the body region and a continuous support for bristles in a radial pattern around the body region between the upper and lower surfaces. The leading edge second corner includes extended and angularly positioned bristles 17, which facilitate reaching into corner regions more thoroughly while the first corner includes a sweeping radius for cleaning broader surfaces.

The present invention comprises a generally flattened implement with an asymmetrical rectangular geometry such that the implement body region presents both broad major faces and narrow minor faces for the attachment of contact material (bristles) thereto. The majority of the surfaces of the body region are rounded to provide a gradient of contact material of uniform thickness around the implement to avoid contact and inadvertent scratching of the surfaces to be cleaned. Referring to the perspective view in FIG. 4, the first leading edge corner 16 of the device presents a larger radius for optimum contact with curving and more open target surfaces. The opposite corner 17 presents a sharp edge, which is a small radius corner or chamfered edge, for the attachment of longer and potentially stiffer bristles to remove dirt or undesired material from corners and creases.

The present invention also comprises an angled sheath 19 for attachment of a handle 30 to the implement 11 in a fashion so as to facilitate maximum surface contact of the major surfaces while enabling the operator to grip the handle 30 without undue contact of the operator's hands to the surface to be cleaned. The angle maintains the implement at a given distance from the user while enabling an ergonomic positioning of the user's hands with respect to the cleaning surface. The handle itself may be comprised of a single member in any number of fixed lengths, more than one member alone or in series to provide a variety of resultant lengths depending on member configuration, or a continuously variable length or telescoping member to provide a virtually unlimited number of equivalent brush handle lengths. The length and angle of the handle keeps contaminated surfaces, dirty wash splash, chemicals, dust, and other contaminates at a distance from the user.

The body of the invention comprises three main components: the implement body region, the sheath, and the handle, as well as sundry subcomponents that facilitate cleaning. The implement comprises a rigid body region surrounded by contact material, wherein the contact material may comprise stiffened bristle elements or softer material.

The implement body region is made of molded plastic or other suitable material of like hardness, density, and/or water-resistance. With the exception of the rear wall 20 (trailing edge of body region), all faces of the body region support bristles or pads of contact material for the application and dispersion of water, soap, or other cleaning products upon the surface of the target fixture, as well as resultant removal of dirt or other undesirable soil or grime from such surfaces. This contact material is of sufficient abrasiveness for scrubbing without damage to finished ceramic, porcelain, tile, fiberglass, plastic, wood, drywall, or other such household surfaces.

The contact material is generally of uniform thickness surrounding the body region on all surfaces saving the trailing end wall to provide for attachment of the sheath and brush handle. The contact material thickness increases slightly at the second leading corner and possesses increased stiffness. This area 17 (referred to herein as the "spike") is designed to allow penetration of any tight corners of the target fixtures thus removing dirt, grime, or other impurities more difficult to reach with the broader surfaces of the contact material. The local thickness of the contact material at the spike 17 shall extend beyond the standard contact material thickness, tapering down to standard thickness gradually in all directions radiating from the spike 17.

The sheath has two purposes: to introduce an angle to the orientation of the handle and provide an attachment mechanism for the handle. An angle between the upper surface of the body region and the brush handle may be provided or the sheath may be aligned with the body region. An angle provides optimum contact of the brush contact material and target fixture surfaces. Alternatively the sheath may be aligned with the body section such that the handle is positioned in plane therewith.

In an angled configuration and when scrubbing the side or bottom of a fixture, for example, the operator of the brush can maintain contact with the brush tip or continuous contact with the implement from a variety of positions both inside and outside the target fixture. The angle of the handle is a feature of the invention that enhances operator usability even while sacrificing some fraction of the nominal normal force that could be otherwise applied through a perpendicular handle. The sheath contains an attachment mechanism to allow the attachment of the handle. The handle is a tubular member of a diameter to allow for a firm grip by large and small hands alike. The overall width of the sheath may need to increase to support the insertion of the handle if the width of the body region is equal to or less than the diameter of the handle. The increased sheath girth may be accomplished by a curve or taper up from the body region. The sheath has similar material properties to the body region and the two may be part of a single mold in the interest of manufacturability.

Further, the sheath contains reinforcement gussets or flanges designed to reduce the stress concentration at the point where the angular sheath meets the body region as this region will be subject to high local stress resulting from the pressure and scrubbing motion from the handle to the body region and surrounding contact material. These reinforcement ridges generally follow the coincident axes of the sheath and handle, flowing seamlessly from the region to the sheath to reinforce this area with increased material area to counteract shear and bending during operation. The reinforcement is also potentially part of the single mold with the body region and sheath.

The handle attachment mechanism may be as simple as a threaded post or more complex such as a deadbolt type latch or spring-loaded peg and matching hole. The critical factor is that the handle segment be removable to allow the interchangeability of different handles or brush heads.

As noted above, the brush handle is a cylindrical component comprised of one or more handle segments joined by attachment mechanisms of the same size as the attachment mechanism of the first handle segment with the sheath. In that way the overall length of the handle may vary to accommodate the scrubbing of very large basins (e.g. pools) or more narrow fixtures such as sinks, toilets, or narrow showers. The diameter of the handle itself may vary locally at the points of each attachment mechanism depending on the particular geometry chosen. These locations could provide additional gripping and leverage to the brush operator, with or without additional components tailored to this purpose. The handle material may be the same as the body region or an alternate strong, lightweight material such as wood or aluminum.

The preferred embodiment of the cleaning implement comprises an asymmetric body region manufactured of molded plastic or other plastic or composite material of like hardness, density, and/or water resistance. The body region includes an asymmetric rectangular shape with filleted edges and an outer surface disposed of a continuous and coextensive array of contact material, a sheath, and a handle attachment mechanism. The contact material is preferably a plurality of stiffened bristles extending from the body region, or the material may be softer for dusting or wiping purposes. The cleaning material in the leading corners of the implement is designed to first clean broadly curving surfaces, and also for cleaning confined areas and sharp corners. The contact material affixed to the second leading corner incorporates the "spike" feature with material of increased stiffness and length such that the spike extends locally therefrom and beyond the standard contact material thickness of the rest of the implement.

Overall, the present invention provides a cleaning implement that is adapted for use with a handle, wherein the implement includes an asymmetric body shape to allow for two distinct cleaning functions: cleaning broad surfaces and also cleaning narrower corner intersections. The device provides a user with an friction-type or contact-type cleaning implement that combines two functions into a single unit, wherein a handle may be attached thereto for cleaning away from the user's body.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A multi-surface cleaning implement, comprising:

a substantially rectangular-shaped body region having a thickness, an upper surface, a lower surface, side edges, a rear wall, and a leading edge with a first and second leading corner;

wherein said first leading corner and said second leading corner are disposed opposite the rear wall;

said first leading corner being arcuate and said second leading corner being a right angle;

wherein said upper surface, said lower surface, said side edges, said leading edge, and said first and second leading corners each have contact material extending therefrom;

wherein the contact material extending from the upper surface, the lower surface, the side edges, and the first leading corner is uniform in length;

wherein the contact material extending from the second leading edge is longer in length than the contact material extending from the upper surface, the lower surface, the side edges, and the first leading corner;

a sheath affixed to said rear wall of said substantially rectangular-shaped body region configured to accept a handle therein;

wherein said sheath extends upwardly at an angle from said rear wall;

wherein said substantially rectangular-shaped body region is asymmetrical about a longitudinal axis of the sheath.

2. The device of claim 1, wherein said second leading corner contact material further comprises contact material of higher stiffness than said remaining contact material on said body region.

3. The device of claim 1, wherein said body region is a largely flattened structure having a short thickness compared to said body region upper and lower surface area.

4. The device of claim 1, wherein said leading edge and side edges comprise a rounded and filleted edge.

5. The device of claim 1, wherein said rear wall is a square wall that is perpendicular to said upper and lower surface and has no contact material disposed thereon.

6. The device of claim 1, wherein said second leading corner comprises a chamfered corner.

7. The device of claim 1, wherein said second leading corner comprises a protruding corner region.

8. The device of claim 1, wherein said contact material comprises stiffened bristles adapted for abrasive cleaning.

9. The device of claim 1, wherein said contact material comprises soft bristles adapted for wiping and picking up dust.

10. The device of claim 1, wherein said sheath comprises a cylindrical sheath for receiving an elongated and cylindrical handle therein.

11. The device of claim 1, wherein said sheath further comprises a first side and second side having a gusset extension attaching said first and second side to said rear wall, thereby providing a gusset reinforcement to said sheath.

12. The device of claim 1, wherein said sheath further comprises an attachment mechanism for securing an elongated handle therein.

13. The device of claim 12, wherein said attachment mechanism further comprises a deadbolt type latch.

14. The device of claim 12, wherein said attachment mechanism further comprises a spring-loaded peg and matching hole.

* * * * *